United States Patent [19]

Holmes

[11] Patent Number: 4,598,274

[45] Date of Patent: Jul. 1, 1986

[54] SECURITY AND PROTECTION PANEL

[75] Inventor: Alan Holmes, Darlington, United Kingdom

[73] Assignee: Romag Holdings Ltd., Bladon on Tyne, England

[21] Appl. No.: 639,309

[22] Filed: Aug. 10, 1984

[30] Foreign Application Priority Data

Aug. 18, 1983 [GB] United Kingdom ..... 8322258

[51] Int. Cl.[4] ..... G08B 13/04; E06B 5/10

[52] U.S. Cl. ..... 340/550; 52/173 R

[58] Field of Search ..... 340/550, 652; 200/61.08; 109/5, 10, 21, 38, 42; 52/306, 789

[56] References Cited

U.S. PATENT DOCUMENTS 3,825,918 7/1974 Laidlaw, Jr. et al. ..... 109/21

3,825,919 7/1974 Levin et al. ..... 340/550

FOREIGN PATENT DOCUMENTS 1278292 5/1967 Fed. Rep. of Germany ... 200/61.08

2026219 1/1980 United Kingdom ..... 340/545

*Primary Examiner*—James L. Rowland

*Assistant Examiner*—Anne Marie F. Capati

*Attorney, Agent, or Firm*—Louis Orenbuch

[57] ABSTRACT

The present invention provides a security panel in the form of a hybrid integrated circuit, comprising a plurality of laminae, at least one of which is provided with a semiconductive coating, said coating not being on the outside of the panel, the semiconductive coating not being present on a narrow edge zone of the lamina to which it is applied, electrodes being provided close to two opposite edges of the panel, one of said electrodes being continued along the narrow edge zone from which the conductive coating has been omitted to an area provided with integrated circuitry necessary for the operation of an alarm system, said area being provided within the laminae and also being connected with the second of said electrodes, electric connections being attached to the integrated circuitry area.

10 Claims, 9 Drawing Figures

External power supply
External alarm relay

Hybrid circuitry
Integrated resistors
Link for low range determined by semi-conductive layer resistance
Panel resistance
5V. Reg
IC1
390R
47µ
16v
100 n
15v
Zenamic
8v
330µ
10v
2K7
470R
100n
27v
0v
K8
1K5
Alarm
33K
1M
47K
100K
0.33µ
R5
R6
6800R
R3
R2
R1
330R
R4
470R
A
B
C
D

SECURITY AND PROTECTION PANEL

The present invention is concerned with a new and improved panel for use in the fields of security and protection.

Security glazing has long been known with alarm glazing units comprising, for example, conductors laminated between panes of glass and similar transparent materials. The necessary electric circuitry, comprising, for example, controlling electronic systems, relays, bridges and the like, are normally situated in a place remote from the glazed security area. This is a fundamental weakness of such security glazing systems since there is always the danger that unauthorised persons can gain access to and can interfere with remote electric circuitry and thus render it non-operational.

Consequently, it is an object of the present invention to provide improved security glazing which does not suffer from the deficiencies and drawbacks of the known security glazing.

Thus, according to the present invention, there is provided a security panel in the form of a hybrid integrated circuit, which may be transparent, semi-transparent or opaque, comprising a plurality of laminae, at least one of which is provided with a semi-conductive coating, which coating is not on the outside of the panel, said semi-conductive coating being omitted from a narrow edge zone of the lamina to which it is applied, electrodes being provided close to two opposite edges of the panel, one of said electrodes being continued along the narrow edge zone from which the conductive coating has been omitted to an area provided with integrated circuitry necessary for the operation of an alarm system, said area being provided within the laminae and also being connected with the second of said electrodes, electric connections being attached to the integrated circuitry area.

The hybrid integrated circuit according to the present invention is physically attack resistant and is capable of being incorporated as a component of a security system, so that ballistic or manual attack upon the hybrid circuit triggers an alarm system. One of the great advantages of this system is that the electronics which perform the attack detection are truly integrated upon the transparent substrate within the panel. Furthermore, the integrated circuitry is novel in that fracture or breakage of any circuit node or connection point will trigger an alarm. Since the integrated circuit is incorporated between strongly bonded laminae, this prevents accidental or intentional tampering therewith.

It has long been recognised in the field of security glazing that, in the case of alarm glazing units comprising, for example, conductors laminated between glass panes, there is always the possibility of access by unauthorized persons to the controlling electronics, relays, bridges, etc. which are normally situated in an area remote from the glazed security area.

The present invention circumvents this by incorporating 'fail safe' and inaccessible electronics integrated upon the surface of a transparent substrate forming a core structure within a security glazing pane.

A preferred embodiment of the present invention comprises hybrid integrated circuitry capable of transmitting both time, location or other data to a central processing unit. Thus, the present invention may be utilised in a large secure area, such as a bank, airport, embassy, military establishment or the like, where, in the event of an attack upon any glazing area, instant identification of the site of attack and real time data would be available to allow a quick response, by emergency/security services.

Signal/data derived from an in situ panel may take several forms, for example constant current sinking and utilising the power lines to the panel both to activate the electronics and to derive an alarm signal. Alternatively, a signal line or lines or a data bus may be brought to the edge connector affixed and bonded to the outer edge of the hydridised panel.

A preferred form of output format utilises an optoelectronic output from the sensing electronics, such output being, for example, a polymeric, glass or silica fibre bonded directly to an appropriate device, such as a gallium aluminum arsenide light-emitting diode, or indirectly via an appropriate coupling device, such as a wistrasse sphere or lenticular coupling system.

The data or signal from the security panel may also be brought to the edge of the panel and used to activate a light-emitting device which is then photon-coupled to an external photoreceiver mounted in the framing system, holding the security panel in place.

A preliminary stage in the production of the security panel according to the present invention is the deposition upon the surface of a substrate of a semi-conductive transparent layer, preferably of tin oxide or indium oxide, or of a semi-transparent metal film or of a film of metallic oxide incorporating at least one transition metal oxide, for example titanium dioxide. The techniques for this application are well known and may involve vacuum sputtering, vacuum evaporation or chemical deposition from, for example, metal halides. A preferred semiconductive material is a mixture of tin and indium oxides incorporating a small amount of antimony as a dopant to reduce specific resistivity. Such a coating may be conveniently deposited from a vapourised mixture of titanium tetrachloride, stannic chloride, indium trichloride and antimony trichloride at a temperature of from 400° to 800° C. When it is desirable not to impair the transparency of the panel as a whole, the semiconductive transparent layer should preferably have a thickness which does not exceed $10\mu$. Generally the light transmission of a coated panel will be in the region of 65%–85% and is preferably of a cosmetically acceptable coloration, a faint straw-yellow tint usually being acceptable.

The transparent substrate with a transparent semiconductive film deposited upon its surface is then further processed to produce the hybrid integrated circuit.

Areas of the transparent semiconductive film are removed by means of photographic and etching techniques so as to form a dielectric isolation between conductors and die attachment pads. The etching process may be a liquid process incorporating a nascent hydrogen producer, for example powdered zinc metal and a strong acid, such as hydrochloric acid.

The preferred range of resistivity of the transparent semiconductive film is preferably from 5 ohm/square to 6 k ohm/square.

Film resistors forming part of the integrated circuitry may be formed by geometric delineation of residual semiconducting film, following localised determination of specific resistance by means of a four point probe resistance meter.

In actual practice, on a substrate measuring 1 m×1.5 m, the etching process can initially produce several isolated areas.

Following etching, the attack detection circuitry is deposited on or attached to a very small corner area of the substrate, for example with an area of 20×25 mm. The vast bulk of the substrate is, therefore, transparent and unetched and may form the through vision part of a security glazing system. Furthermore, this large unetched area is itself, by reason of its specific resistivity, an excellent sensor for substrate breakage. Such breakage, cracking or fracture of the substrate increases the resistance betwen ohmic electrodes deposited upon the periphery of the large semiconducting area, this increase in apparent resistance being sensed by the hybrid detection circuitry and processed so as to produce an output which will trigger an alarm.

The area of the hybrid detection circuit may be coated with a silicone gel or other protective agent, prior to incorporating the substrate between further layers of glass or other transparent material, so as to form a transparent hybrid integrated circuit which is a truly physically-attack resistant component.

Thus, in terms of being resistant to physical attack, ballistic attack or blast, the present invention provides a means of increasing the resistance to such an attack by specifically increasing its strength and thickness by means of further transparent components, which may, for example, be glass or a transparent acrylic resin, a non-plasticised polyvinyl chloride, a polysulphone, a polyether sulphone, a polymethylpentene, a polyethylene terephalate, a polycarbonate or the like.

A further preferred embodiment of the invention comprises, within the laminae, several substrate layers of metal oxide-coated glass, separated by polymeric films. Such an assembly is capable of differentiating between ballistic, manual and accidental surface cracking, when coupled to integrated electronic circuitry.

High energy ballistic impact generally causes immediate shattering of most of the incorporated substrate panes, whereas in a manual attack situation, shattering of the internal substrate panes occurs in a time delayed mode, which shattering need not be sequential. Low energy accidental impact may only shatter a surface pane. Thus, by analysing time/resistivity data derived from the security glazing panel, an indication of the type of attack or of the degree of shattering is available.

It is well known to those involved in security electronics that electromagnetic spurii derived from lighting, radio transmissions and the like may adversely affect electronic detection systems, thus causing false alarms. Thus, according to a preferred embodiment of the present invention, there are incorporated further transparent semiconductive electrodes which form a faraday shield around the transparent substrate carrying the detection electrodes. These can be made, for example, of tin oxide. The transparent electrodes forming the faraday shield are 'earthed' to the electronic system 'earth'. The preferred resistivity of the faraday shield electrodes is $<5$ ohm/sq.

The screen according to the present invention is further provided by this means with the feature of being opaque to electromagnetic radiation and may be used as a security glazing panel incorporated into an electromagnetically screened room or 'safe house'. Furthermore, by increasing the optical density of the film of semiconducting material by chemical or other deposition, the panel may be used as a 'one way' mirror, dependent upon differential lighting conditions.

For a better understanding of the present invention, reference will be made to the accompanying drawings, in which.

Figure 5B:
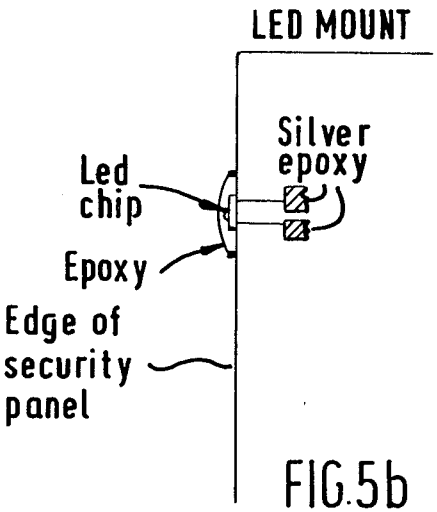
Figure 5A:
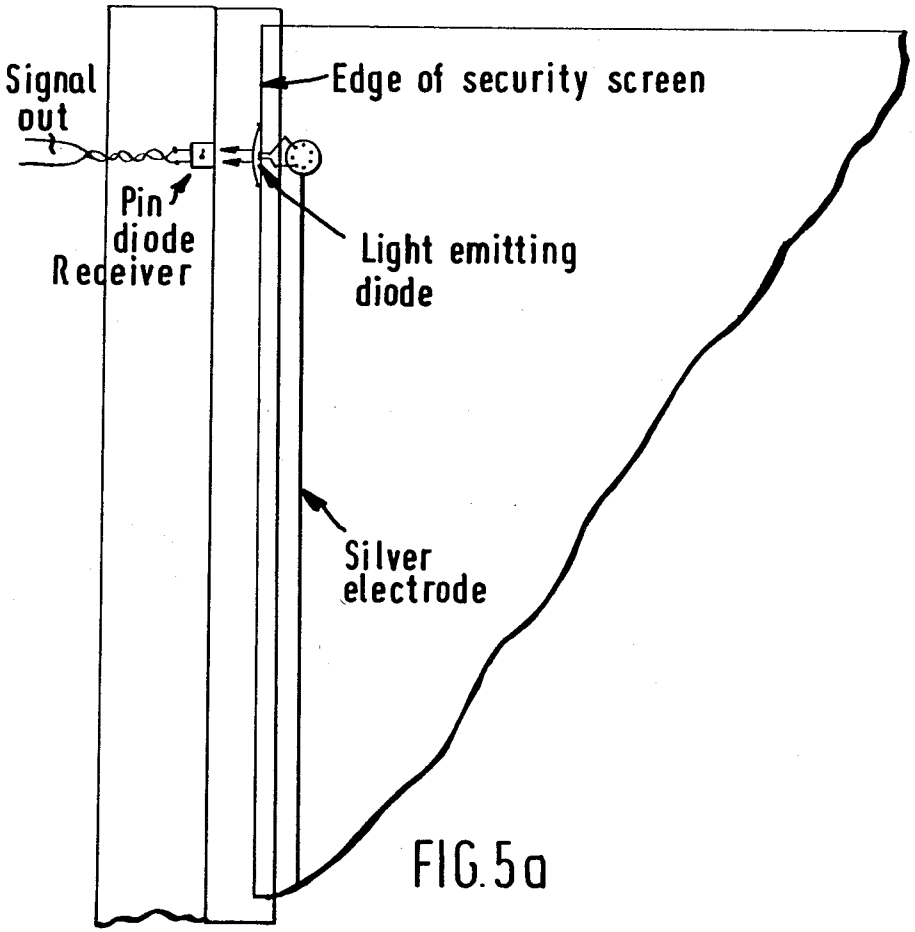

FIG. 5*a* is a partial view of a security panel incorporating a light-emitting device;

FIG. 5*b* is an enlarged view of the light-emitting diode mount of FIG. 5*a;*

Figure 6:
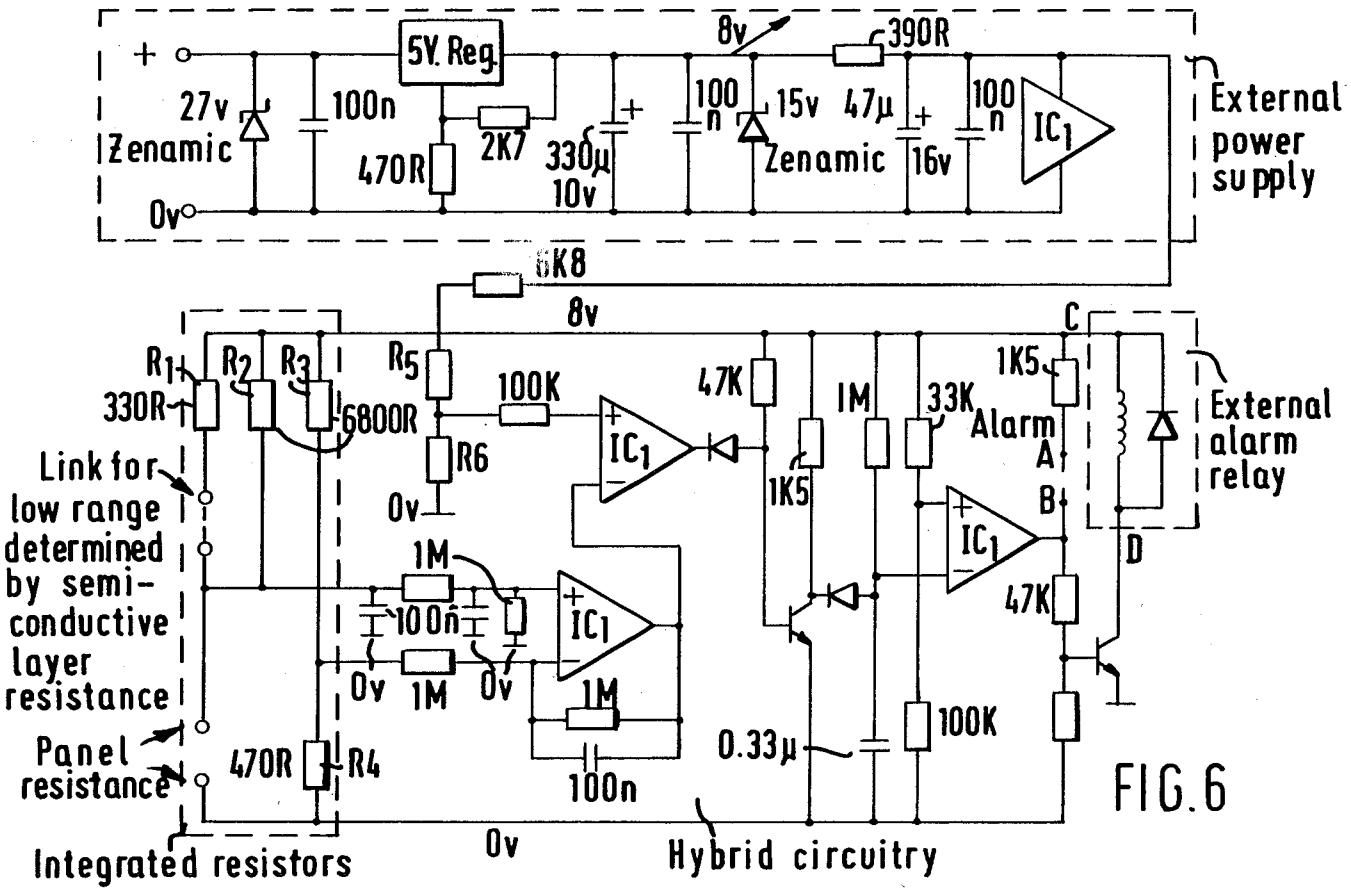
Figure 7:
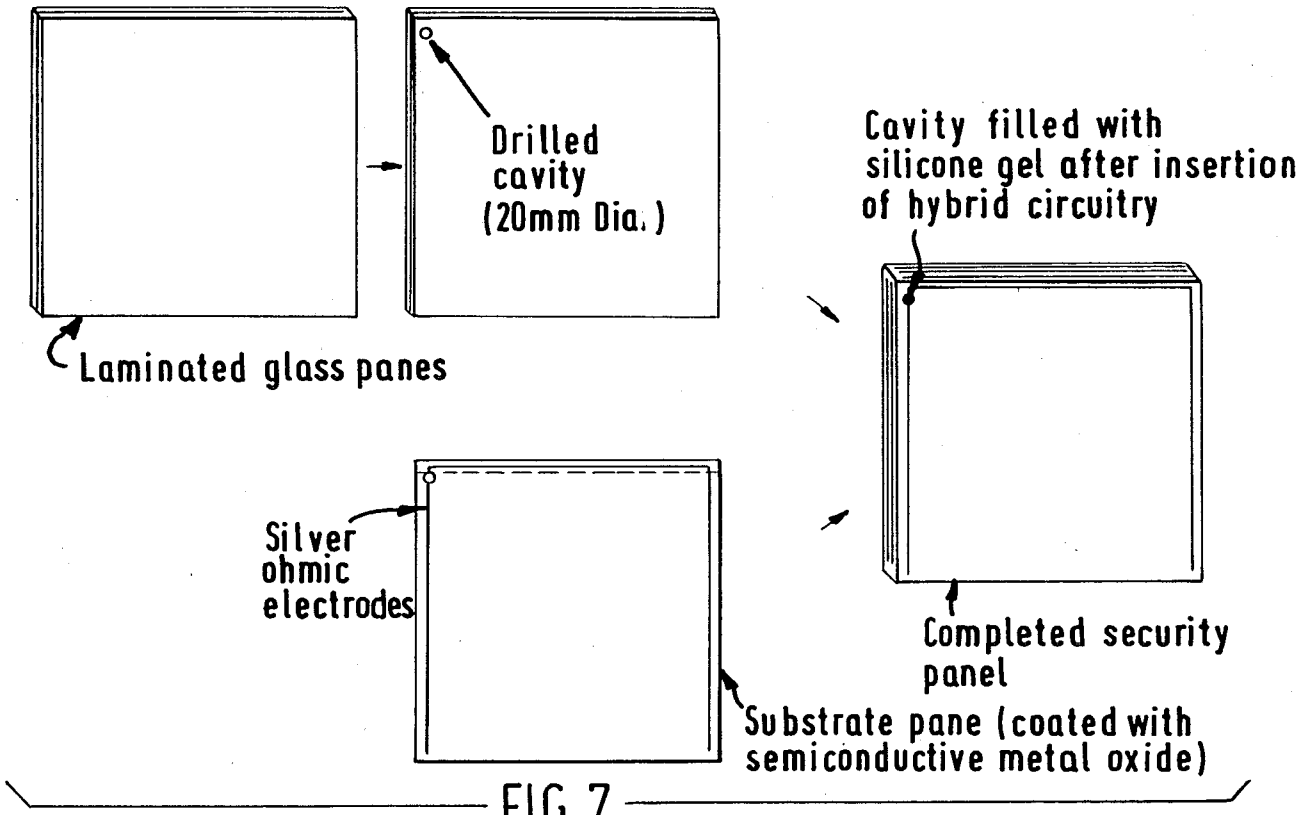
Figure 8:
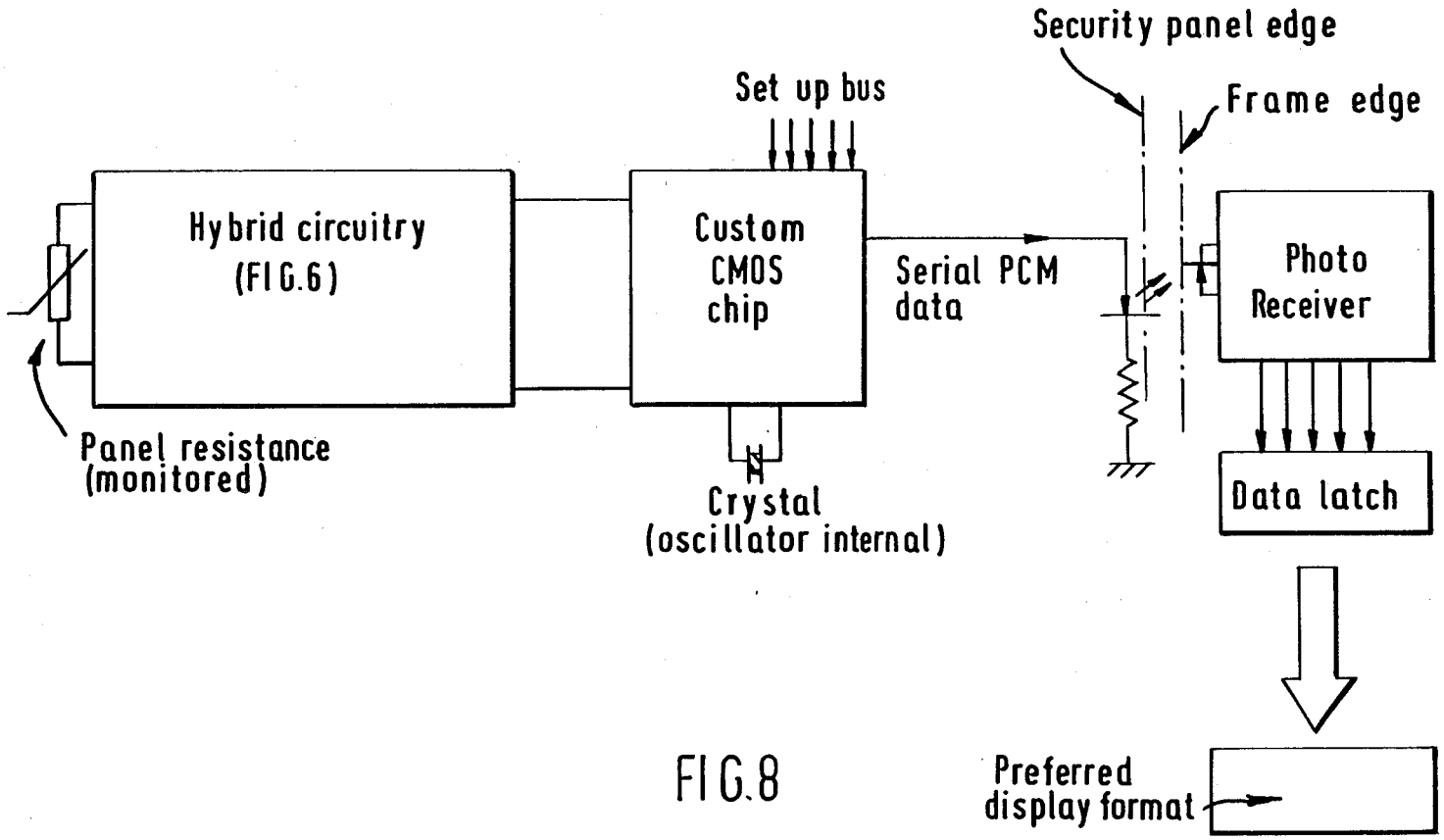

FIG. 6 illustrates a typical alarm/detector circuit;

FIG. 7 is a diagrammatic illustration of the production of a security panel according to the present invention; and FIG. 8 is a diagrammatic illustration of one embodiment of suitable circuitry.

Figure 1:
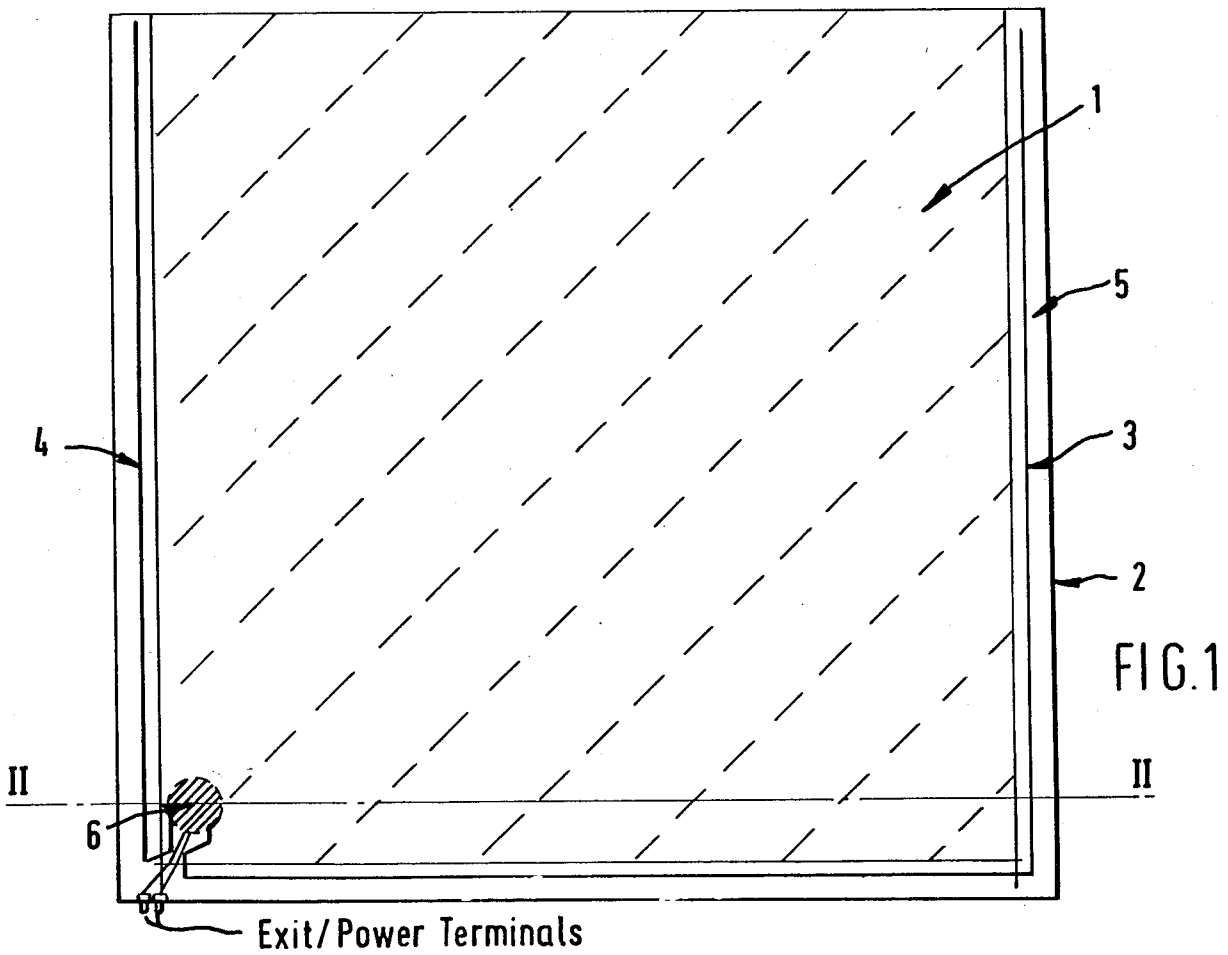
FIG. 1 is a view of a security panel according to one embodiment of the present invention.

Referring now to FIG. 1, the security panel according to the presentinvention comprises several laminae of glass and/or synthetic resin material. A conductive film or coating (1) is provided on a thin sheet of glass (2) which ensures that even quite a small impact will cause fracture of the glass and thus of the conductive coating (1) which, in turn, will result in a change in the resistance of the conductive coating (1) as a whole, which results in the triggering of an alarm system.

The electrodes (3, 4) provided can consist of any appropriate conductive material, a metal, such as silver, being preferred. As can be seen from FIG. 1, a peripheral area (5) of the glass sheet (2) is free of conductive film or coating, this peripheral area (5) containing the electrodes (3, 4).

Figure 2:
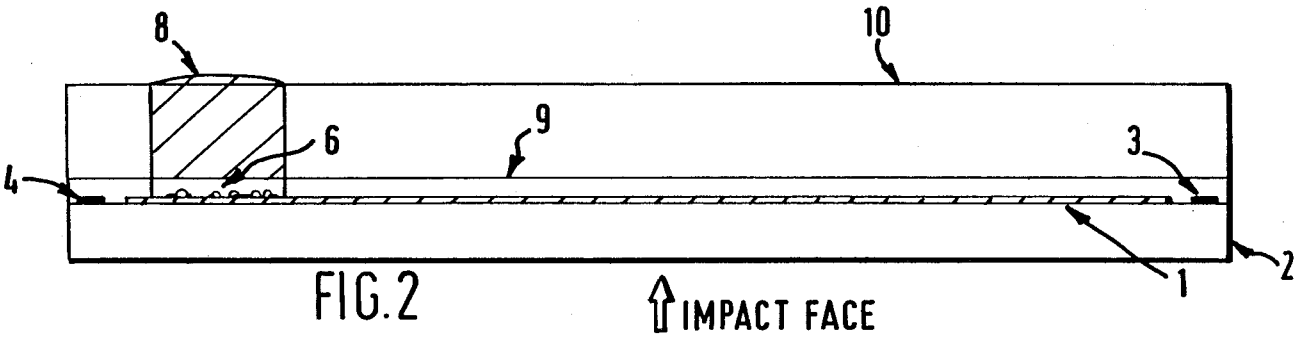
FIG. 2 is a section along the line II—II of FIG. 1.

As can be readily seen from FIGS. 1 and 2, integrated circuitry (6) and associated exit/power terminals (7) are in one corner of the panel. FIG. 2 shows the integrated circuitry positioned within the laminated screen and protected by an epoxy infill (8), the conductive coating (1) being covered by a film (9) of polyvinylbutyral and glass laminae (10).

Figure 3:
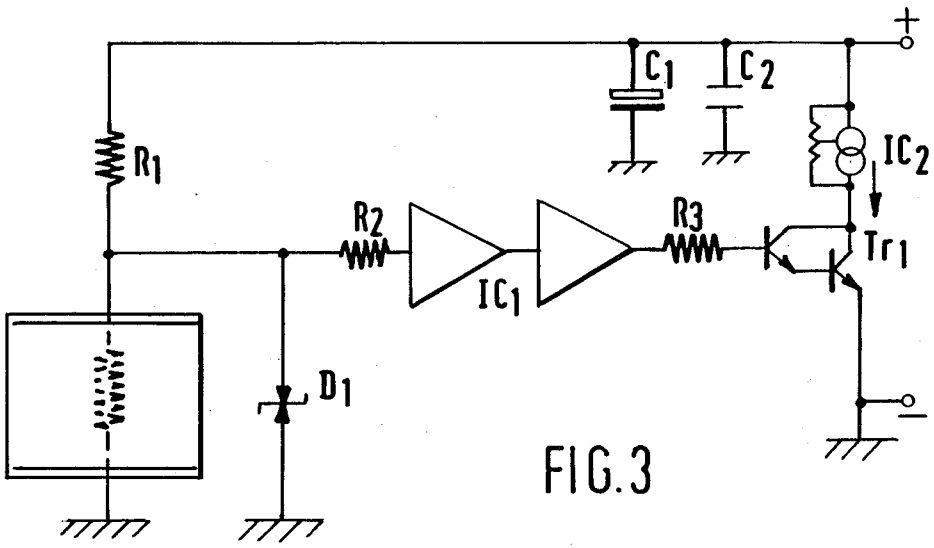
FIG. 3 is an enlarged view of one embodiment of the integrated circuitry utilising a current sinking mode.

The integrated circuitry illustrated in FIG. 3 is to be understood to be merely one example of the circuitry which can be employed. Thus, for example, the circuitry can also, if desired, include a photoelectric detector or other means which would detect the removal or attempted removal of the frame in which the screen is mounted and, as mentioned hereinbefore, can also include appropriate means for preventing the adverse effects of electromagnetic spurii.

The integrated circuitry within the laminated screen is preferably either encapsulated or provided with a protective gel which fills the spaces and interstices between the circuitry and the surrounding laminae.

Figure 4:
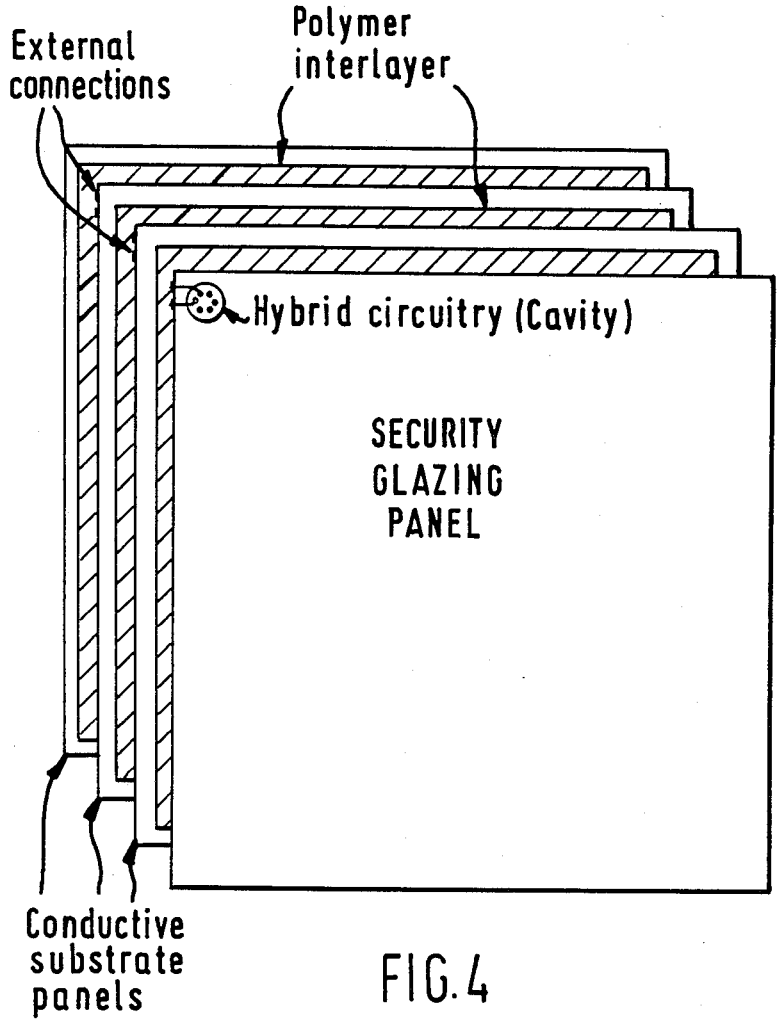
FIG. 4 is an exploded view of a security panel according to another embodiment of the present invention.

In FIG. 3 of the accompanying drawings, the references used have the following meanings:

$R_1$=input current set resistor
$R_2$=input $Ic_1$ protection resistor
$R_3$=transistor drive limit resistor
$D_1$=transient suppressor
$Ic_1$=chip integrated circuit
$Tr_1$=Darlington transistor chip
$Ic_2$=integrated circuit
$C_1$=0.01 μF thick film capacitor
$C_2$=10 μF tantalum chip capacitor FIG. 4 of the accompanying drawings illustrates a preferred embodiment of the panel according to the present invention in which several substrate layers of metal oxide-coated glass, which are separated by polymeric films, are provided within the laminae. When coupled with appropriate electronic circuitry, such an assembly is capable of differentiating between ballistic, manual and accidental surface or superficial cracking.

According to a further embodiment of the present invention, which is illustrated in FIG. 5 of the accompanying drawings, data or signals from the security panel may also be brought to the edge of the panel and used to activate a light-emitting device (LED) which is then photon-coupled to an external photoreceiver mounted in the frame system holding the panel in place. Such an embodiment of the panel permits detection of tampering with or attempts to remove the panel from its holding frame.

The following Examples are given for the purpose of illustrating the present invention:

EXAMPLE 1

Referring to FIG. 7 of the accompanying drawings, a security glazing panel (500 mm.×500 mm.) was produced in the following manner: three panes of glass with thicknesses of 6 mm., 6 mm. and 10 mm., respectively, were laminated by means of conventional glass laminating technology, using a plasticised polyvinyl butyral film. Following the lamination, a hole of 20 mm. diameter was drilled through one corner of the panel to allow the subsequent insertion of hybrid circuitry.

A prepared and pre-etched substrate pane of glass of 5 mm. thickness coated with metal oxide was then laminated to the thicker prepared glass laminate panel, such that pads of silver epoxy composition were accessible via the 20 mm. diameter cavity produced by the lamination technique.

Resistors $R_1$, $R_2$, $R_3$, $R_4$ were previously integrated upon the metal oxide surface by photoetching techniques. The hybrid integrated circuitry shown in FIG. 6 of the accompanying drawings was then inserted through the cavity, the circuitry being carried upon a circular alumina substrate of 13 mm. diameter. Connection between the glass substrate layer and the alumina substrate was made by the application of further silver epoxy compound.

Resistors $R_5$, $R_6$ were integrated within the hybrid circuit, such that the external relay was held in the 'on' condition, the relay 'dropping out' following breakage of the substrate, loss of power or damage to the hybrid circuitry, thus triggering an alarm condition.

After checking the circuit for operation, the cavity was filled with a semi-flexible silicone gel with a Shore hardness of 30.

The resulting complete panel was tested operationally by firing a single round from a 0.38 special revolver. No penetration resulted. An alarm condition was registered 0.5 second after impact (relay contacts open). Five further shots were fired at the panel and again no penetration resulted.

In FIG. 6, $Ic_1$ is an industrial standard quad operational amplifier type 324 (chip). All resistors are 100 ppm°C. tolerance thick film, all diodes are general purpose silicon and all capacitors are monolithic ceramic types (chips).

FIG. 6 should be understood to be an illustration of a basic bridge/window detector, monitoring the resistance of the transparent surface electrode, and is merely one example of the type of hybrid circuitry which may be used. To those skilled in the art of electronic hybrid circuitry, production of alternative configurations will present no difficulty.

EXAMPLE 2

A panel was produced as in Example 1 but a gallum aluminum arsenide light-emitting diode was attached to the edge of the panel, by means of a silver epoxy compound, between points A and B in FIG. 6.

Upon shattering of the panel following ballistic impact, an alarm condition produces infra-red emission from the diode, triggering an alarm condition when photon-coupled to an external photo receiver mounted in an external framing system (see FIG. 5).

EXAMPLE 3

A further panel was produced as in Example 1. The infra-red emitting diode and current-limiting resistor were connected across points C and D in FIG. 6. Infra-red light emission from the diode is constant but ceases and triggers an alarm condition when subjected to ballistic impact. Removal of the frame also triggers an alarm condition via loss of the optical path between the emitting diode and the photoreceiver.

EXAMPLE 4

A panel was produced as in Example 1 but, in place of the external relay, an internal CMOS integrated circuit was incorporated into the hybrid integrated circuit, allowing serial data indicating the position and time to be transmitted via a light-emitting diode to an externally mounted photoreceiver.

Upon testing the panel ballistically, signal dropout occurred, latched data being available indicating the time of attack and the relative position of the panel (see FIG. 8 in which power lines are omitted for the sake of clarity).

The custom made CMOS chip incorporates an on-board crystal oscillator and is present via a five data line address bus. The output from the CMOS device is a pulse code modulated serial data line, which is decoded by the photoreceiver via the photon-coupled infra-red linkage. Other types of circuitry may be used in this mode, FIG. 8 only being given by way of example.

I claim:

1. In a security panel of the type having (i) a plurality of transparent overlying sheets forming a laminated transparent panel, (ii) a transparent coat of semiconductive material disposed upon a surface of one of the sheets, the coated surface being in the interior of the panel, and (iii) electrodes disposed on the panel at opposite edges of the transparent coat and providing electrical connections to the transparent coat, the improvement comprising (a) integrated circuit means for sensing a change in the electrical resistance of the transparent semiconductive coat, the integrated circuit means being situated in the interior of the panel adjacent an outer edge thereof, (b) signal transmission means disposed adjacent an outer edge of the panel and coupled to the integrated circuit means for transmitting signals from the integrated circuit means to an external receiver, and wherein (c) the aforesaid electrodes electrically connect the semiconductive coat to the integrated circuit means by paths situated internally in the panel.

2. The improvement according to claim 1, further including (d) means on the panel for providing a faraday shield for the semiconductive coat, the integrated circuit means, and their interconnections.

3. The improvement according to claim 1, wherein the integrated circuit means includes means for outputting signals identifying the location of the panel.

4. The improvement according the claim 3, wherein the integrated circuit means further includes means for outputting time signals.

5. The improvement according to claim 1, wherein the signal transmission means comprises optoelectronic means disposed in the interior of the panel adjacent an outer edge thereof.

6. The improvement according to claim 5, wherein the optoelectronic means includes a light emitter for emitting light signals to the external receiver.

7. The improvement according to claim 1, wherein the signal transmission means comprises a multiple lead electrical connector affixed to an outer edge of the panel.

8. The improvement according to claim 1, wherein the transparent coat of semiconductive material is a mixture of tin and induim oxides and a specific resistivity reducing dopant.

9. The improvement according to claim 8, wherein the specific resistivity reducing dopant is antimony.

10. The improvement according to claim 9, wherein the transparent coat of semiconductive material is a film whose thickness does not exceed $10\mu$.

* * * * *